United States Patent [19]

Davey et al.

[11] Patent Number: 4,920,092

[45] Date of Patent: Apr. 24, 1990

[54] DYESHEETS

[75] Inventors: Roger J. Davey, Hoole Chester; Duncan H. MacKeron, Frodsham, both of England

[73] Assignee: Imperial Chemical Industrices PLC, London, England

[21] Appl. No.: 202,588

[22] Filed: Jun. 6, 1988

[30] Foreign Application Priority Data

Jun. 5, 1987 [GB] United Kingdom ..... 8713242

[51] Int. Cl.[5] ..... B41M 5/035; B41M 5/26

[52] U.S. Cl. ..... 503/227; 8/471; 428/913; 428/914

[58] Field of Search ..... 8/471; 428/913, 195, 428/914; 503/227

[56] References Cited

U.S. PATENT DOCUMENTS 4,720,480 1/1988 Ito et al. ..... 503/227

*Primary Examiner*—Bruce H. Hess

*Attorney, Agent, or Firm*—Cushman, Darby Cushman

[57] ABSTRACT

A thermal transfer dyesheet, comprising a supportive base material coated with a composition of a thermally transferable dye dispersed uniformly throughout a polymeric binder matrix, also contains in its coating composition a crystallization inhibitor having a molecular structure consisting essentially of a polymer backbone to which are chemically bonded a multiplicity of groups having substantially the same shape, charge distribution and hydrogen bonding pattern as the dye or substantial portion thereof.

Provision of such crystallization inhibitors serves to reduce the problems of roughness on the dyesheet surface, and the dirty surfaces which both have tended to occur in previous dyesheets as the dye molecules migrate to the surface and combine to form crystals there.

5 Claims, No Drawings

DYESHEETS

The invention relates to dyesheets for thermal transfer printing, and in particular to the composition of dye-containing layers in such dyesheets.

Thermal transfer printing is a technology by which prints can be obtained from electronic signals, by heating selected areas of a dyesheet to cause dye to be transferred to a receiver sheet held adjacent to the dyesheet. The areas to be heated are selected in an appropriate transfer printing apparatus according to the electronic signals and provide individual pixels which together combine to form a print representing those electronic signals. This may be in the form of recorded data, comprising for example letters, numbers and diagrams in a single colour, but the technology is broader in its application potential than that, in that by using a plurality of appropriate dyes and small pixels, a colour print can be built up from appropriate signals, such as those derived from a video or electronic still camera.

Typically a thermal transfer dyesheet comprises a supportive base material coated with a composition of a thermally transferable dye dispersed uniformly throughout a binder matrix. The supportive base material is usually a thin polymeric film, such as biaxially orientated polyester film, and the binder matrix in which the dye is dispersed may typically be a silicone or cellulose material, although other polymeric binders can also be used. However, although dyesheets can be produced by co-casting binder and dye from a common solvent onto the supporting film to form a coating which is initially satisfactorily uniform, a drawback common to at least most of such systems is that such uniformity is only temporary. Over a period of time the dispersed dye molecules tend to agglomerate and form a separate phase in the form of small crystals. This can result in the surface of the dyesheet becoming rough and the resolution being reduced, although the latter may only become a problem where prints of photographic or near photographic standards are required. A more general problem is that the dyesheets tend to become dirty, some of the dye being easily rubbed off the dyesheet or otherwise transferred when the dyesheet is handled.

We have now found a way of modifying the coating composition so as to reduce these problems.

According to a first aspect of the present invention, a thermal transfer dyesheet comprises a supportive base material coated with a composition of a thermally transferable dye dispersed uniformly throughout a polymeric binder matrix, characterised in that the composition also contains a crystallisation inhibitor having a molecular structure consisting essentially of a polymer backbone to which are chemically bonded a multiplicity of groups having substantially the same shape, charge distribution and hydrogen bonding pattern as the dye or substantial portion thereof.

According to a second aspect of the invention, a composition for coating a supportive base material in the manufacture of a thermal transfer dyesheet, comprises a thermally transferable dye, a polymeric binder material and a crystallisation inhibitor having a molecular structure consisting essentially of a polymer backbone to which are chemically bonded a multiplicity of groups having substantially the same shape, charge distribution and hydrogen bonding pattern as the dye or substantial portion thereof.

The preferred groups to be bonded to the polymer backbone are those essentially the same as individual dye molecules differing only at the position at which they are bonded to the backbone. However, where the nature of the dye is such that some minor substitution does not significantly affect the shape, charge distribution and hydrogen bonding parameters of the dye, they may provide alternatives to the dye moiety itself. We have even found that when some minor portions are missing altogether, the remaining substantial portions may provide inhibition when linked to the polymer backbone. Thus by substantial portion of the dye in this context we mean a portion which is sufficient to mimic the crystalisation behaviour of the free dye. Particularly beneficial, however, is replacement of one substitutent of a dye by another of similar shape but different electron affinity so as to compensate for any change in charge distribution due to the presence of the polymer backbone, can be beneficial. Also, bonding of the groups to the backbone through a flexible linking group may provide greater conformational freedom than is possible with direct bonding, but the effect of this will be very dependent on the matrices of both the backbone and the groups attached to it.

We prefer to select as polymer backbone a material which is compatible with the polymeric binder matrix in which the dye is dispersed, in order that these will form a stable blend. While this may give enhanced results, it does not appear to be essential for achieving at least some improvement in the coating with respect to the agglomeration problems referred to above.

A preferred dyesheet is one in which the crystallisation inhibitor is present as 0.01–10% w/w of the dye.

The invention is illustrated by the following Examples. To evaluate the present additives as crystallisation inhibitors for thermal transfer dyesheets, various dyesheet coating compositions were prepared and compared. In a first series of these, several different additives were used in varying quantities, but the dye and the binder were kept constant in order to enable a true comparison to be made between the different additives. The dye used was a red anthraquinone dye having the structure

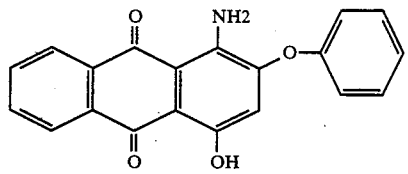

and the binder was a thermally curable silicon resin, although the tests below (except the control Example 1) were carried out at room temperature without the thermal curing step that would normally be used in practice, in order to monitor on a convenient timescale the effect of incorporating these additives. Both the dye and the silicone binder were materials known to suffer from crystallisation problems when used in thermal transfer dyesheets. We found that in combination they provided a particularly unstable system giving rapid crystallisation, thereby enabling the effects of the present inhibitors to be more readily compared, and for these reasons were selected as the model for demonstrating the present use of these inhibitors.

EXAMPLE 1

(Control-A)

A dye binder film was cast from a solution of the basic dye-binder composition as a control, i.e. without any additives, onto a backing of "Melinex" polyester film. The solution was in methyl ethyl ketone, a common solvent for both dye and binder. Immediately upon removal of the solvent, the film appeared as an amorphous, featureless blend of polymer and dye. However, before thermal curing was complete, the red dye was seen to crystallise. Large growths, which would probably be spherulitic in the bulk, appeared as two dimensional rosettes, several tens of microns in diameter in the binder film, whose thickness was about one micron. The image of such rosettes could be transferred to a receiver sheet during thermal printing and in addition the film became dirty in that the red dye could transfer to one's hands when handling the dyesheet.

EXAMPLES 2-4

Compositions according to the present invention were prepared by copolymerising p-vinyl phenol and styrene, and then grafting the anthraquinone chromophore onto the backbone of the copolymers.

p-Vinyl phenol: Para-vinylphenol was prepared as follows. 15.6 g of p-hydroxycinnamic acid were mixed to a slurry with 15 ml quinoline, 0.6 g copper turnings and 1.1 g hydroquinone. The mixture was heated by an oil bath at 200° C. for 15 minutes after which time the evolution of CO2 had almost ceased. The reaction mixture was then cooled and distilled under rotary pump vacuum, the fraction collected between 60° and 80° C. being p-vinylphenol and quinoline. (Bpt. Quinoline=114° C./15 mm Hg; p-vinylphenol=115° C./16 mm Hg). The distilled fraction was taken up into warm diethyl ether, the solution neutralised by successive washing of N HCl and distilled water and then dried by MgSO4. After removal of the solvent, the residue was redissolved by warm petroleum ether (40°-60° C.). On cooling 1.36 g of colourless, platey crystals were obtained. Yield=11.76%. These were recrystallised from the same solvent prior to copolymerisation.

Styrene: Styrene was freed from inhibitor and purified by vacuum distillation.

Copolymerisation: Four bulk copolymerisations of vinylphenol with styrene were carried out using the monomer feed ratios listed in Table 1 (expressed as mole fraction of vinyl phenol in the monomer feed). All systems were degassed by nitrogen and sealed under the inert atmosphere before placing in a bath at 60° C. The initiator used was azobisisobutyronitrile (AIBN) and polymerisations were allowed to continue for 50 hours. The copolymers were recovered by dissolving the reaction mixture in methyl ethyl ketone (MEK) and precipitating by methanol. The same solvent-nonsolvent system was used to purify each copolymer.

TABLE 1

| Copolymerisation of vinyl phenol and styrene | | | |
|---|---|---|---|
| Example | 2 | 3 | 4 |
| Monomer feed | 0.044 | 0.106 | 0.141 |
| Total monomer weight g | 10 | 10 | 10 |
| AIBN % w/w | 0.20 | 0.19 | 0.19 |
| Yield % | 24 | 22 | 8 |
| Copolymer reference | Copol 1 | Copol 2 | Copol 3 |

Grafting reaction: The reaction analogous to that commonly used in the synthesis of low molar mass anthraquinone dyes, was used to graft the anthraquinone moiety to the molecular backbones of the copolymers. Thus typically, 0.78 g of a copolymer prepared previously was dissolved in 10 ml dry N-methyl pyrrolidone (NMP) together with 1:1 molar equivalents of 1-amino-2-bromo-4-hydroxy-anthraquinone and 2 molar equivalents of sodium carbonate. The solution was stirred continuously under static nitrogen at 135° C. and the progress of the graft reaction monitored by removing aliquots of the solution at regular intervals and testing by thin layer chromatography. The reaction was continued for a total of about 20 hours. Table 2 summarised the experimental conditions under which three styrene-vinylphenol copolymers were grafted.

After reaction, the grafted copolymer was recovered by precipitation by methanol. It was purified further either by extraction by methanol or by precipitation by methanol from a solution in MEK. Finally, the grafted copolymer was dried overnight in vacuo at 40° C. and stored in the dark, in a refrigerator.

TABLE 2

| Grafting of chromophore to copolymer | | | | |
|---|---|---|---|---|
| Example | | 2 | 3 | 4 |
| Copolymer grafted | | Copol 1 | Copol 2 | Copol 3 |
| Wt of copolymer | g | 0.9363 | 0.6304 | 0.6012 |
| [OH] | millimoles | 0.418 | 0.562 | 0.805 |
| Wt AQBr* | g | 0.1498 | 0.1938 | 0.2894 |
| [Br] | millimoles | 0.471 | 0.609 | 0.928 |
| Wt $Na_2CO_3$ | g | 0.0997 | 0.1068 | 0.1705 |
| Volume NMP | ml | 10 | 10 | 7 |
| Duration | hrs | 19.5 | 21 | 21 |
| Temperature | °C. | 135 | 135 | 135 |
| Yield | % | 78 | 67 | 67 |
| Additive reference | | Copol 1G | Copol 2G | Copol 3G |

*AQBr = 1-amino-2-bromo-4-hydroxy-anthraquinone

Dye binder system

A hand operated K-bar coater was used to co-cast the film of red dye and silicone binder from MEK onto a 6 μm Melinex support film. Upon removal of the solvent the final thickness of the binder was approximately 1 μm. In this work a stock solution of dye and binder in MEK was prepared according to the formula 20.8 g silicone solution (30% w/w in toluene)
20.8 g MEK
0.080 g Red dye i.e. without cross-linking and curing agents, for the silicone. 2.5 ml portions were used for each experiment, and to each was added a portion of the grafted copolymer. The weight of the anthraquinone moiety chromophore present in the additive was calculated and expressed as a weight of the dye content for each dye-binder system. The correlations between rates of crystalisation and weight % of additive were then compared. The results are tabulated in Table 3.

EXAMPLES 5 AND 6

Two further comparative studies. In the first a low molecular weight derivative (LMWD) of the same anthraquinone dye (1-amino-4-hydroxy-2-(4-t-butylphenoxy)-anthraquinone) was added to the coating composition instead of the high molecular weight grafted polymer backbone of the previous examples. In the other, a high molecular weight material (polystyrene) without the grafted dye moieties was added.

These additives were used in a wide range of concentrations. Over the range covered by the grafted additives, i.e. up to about 5% by weight of the dye, very little effect was observed, and in the case of polystyrene this continued even at higher concentrations. However, by increasing the concentration of the low molecular weight derivative to much higher levels than those used for the present grafted polymer backbones, similar good reductions in rate of crystallisation were obtained, but no reductions in the amount of nucleation per unit area were observed. These results are also included in Table 3 below, for comparison.

TABLE 3

CRYSTALLISATION OF 13.% w/w DYE IN SILICONE BINDER FILM

| EXAMPLE | ADDITIVE (wt %) | Rate (mm/min) | TIME PER 13 mm² (secs) | NUCLEI PER 13 mm² |
|---|---|---|---|---|
| 1 | None | 0.735 | 240 | 340 |
| 2 | 0.8 Copol 1G | 0.696 | — | 5 |
| | 1.6 " | 0.747 | — | 9 |
| | 2.5 " | 0.684 | — | 16 |
| 3 | 1.0 Copol 2G | 0.627 | 705 | — |
| | 1.9 " | 0.528 | 977 | — |
| | 2.8 " | 0.543 | 912 | — |
| 4 | 1.7 Copol 3G | 0.705 | 802 | 12 |
| | 3.3 " | 0.606 | 830 | 19.5 |
| | 5.1 " | 0.585 | 940 | 19 |
| 5 | 4.6 LMWD | 0.741 | 328 | 267 |
| | 9.5 " | 0.519 | 405 | 177 |
| | 13.5 " | 0.492 | 421 | 306 |

EXAMPLES 7–10

In a second set of experiments a different polymeric binder, ethyl hydroxy ethyl cellulose ("EHEC"), was used and a further set of polymeric crystallisation modifiers was prepared for study. The dye that was used was the same red anthraquinone dye as that used in the preceding examples.

In order to enhance the efficiency of the polymeric crystallisation modifier in the binder polymer it was decided that more intimate mixing between the additive and binder should be encouraged. to this end the second series of grafted polymeric additive was prepared with a chemical structure that was similar to the polymer binder, EHEC.

Using Hydroxypropyl cellulose ("HPC"), a chemical synthesis was then carried out to append the anthraquinone dye structures at random positions along the HPC backbone. In this second set, the grafted chromophore, 1-amino-2-bromo-4-hydroxyanthraquinone comprised only a substantial portion (as hereinabove defined) of the molecular structure of the free dye, i.e. omitting the terminal phenoxy group. It was linked to the cellulose backbone via a flexible link that was provided by the hydroxypropyl units already present in HPC.

Grafted HPC: The grafted polymers were prepared using the quantities and conditions listed in Table 4.

Identical procedures were followed for the final synthesis of each additive. Thus 10 g HPC, which had been dried in a vacuum oven overnight 60° C., removed and stored in a dessicator, were added to 100 cm³ of freshly distilled N-methylpyrrolid-2-one ("NMP") in a 250 cm³ round-bottomed flask. The mixture was heated to approximately 85° C. at which temperature the polymer dissolved. The appropriate quantities of 1-amino-2-bromo-4-hydroxy anthraquinone ("AQBr") and catalyst, sodium carbonate were added to the flask which was fitted with a condenser. The apparatus was clamped and the reaction vessel placed in an oil bath which was kept at constant 135° C. The stirrer was then switched on and the reaction was carried out for a specific time interval, until the grafting reaction had gone to completion.

Thin layer chromatography was used to monitor the reaction progress. Aliquots of the reaction mixture were taken every hour and from inspection of the chromatograms, the reaction was judged complete when free dye ceased to move up the paper. An intense purple-coloured spot remained at the origin, Rf=0.

After each reaction had gone to completion, the grafted polymer was recovered.

The viscous, purple liquid from each synthesis reaction was added dropwise to a beaker fitted with an electrical stirrer, containing approximately 1 dm³ of diethyl ether. A sticky purple solid was formed in each case which was thought to contain residual NMP. Any free dye remaining in the same was removed by the diethyl ether. The ether was then decanted off and the polymer was put into the vacuum oven overnight at a temperature of 60° C. The sample was then removed from the oven, dissolved in 150 cm³ methanol, and added dropwise to a beaker containing 1–5 dm³ ethyl acetate. A fibrous precipitate was formed. The solution was filtered and the fibrous polymer collected was dried in the vacuum oven at 60° C. The polymers were further purified by redissolution and reprecipitation before analysis and study.

TABLE 4

EXPERIMENTAL CONDITIONS FOR THE SYNTHESIS OF THE POLYMERIC CRYSTALLISATION INHIBITIOR

| EXAMPLE | POLYMER GRAFTED | MASS POLYMER g | MASS AQBr* g | MASS $Na_2CO_3$ g | VOLUME NMP cm³ | TEMP °C. | DURATION HRS | THEORETICAL GRAFTING | COPOLYMER |
|---|---|---|---|---|---|---|---|---|---|
| 7 | HPC | 10 | 0.7953 | 1.3246 | 100 | 135 | 19 | 5 | gHPC-5 |
| 8 | HPC | 10 | 1.5967 | 2-6493 | 100 | 135 | 22 | 10 | gHPC-10 |
| 9 | HPC | 10 | 2.3951 | 3.9739 | 100 | 135 | 26 | 15 | gHPC-15 |
| 10 | HPC | 10 | 3.1935 | 5.2985 | 100 | 135 | 27 | 20 | gHPC-20 |

*1-amino-2-bromo-4-hydroxyanthraquinone.

CHARACTERISATION

The four polymers synthesised from the grafting reaction involving 1-amino-2-bromo-4-hydroxy anthraquinone and hydroxypropylcellulose were characterised using various techniques.

UV/visible Spectrometry

Solutions of known concentration of each of the grafted polymers were prepared in methanol and UV spectra run for each sample. The instrument used was a Pye-Unicam PU8800 which operated in the frequency range 400–700 nm.

NMR Analysis

Using a Jeol FX-100 instrument which operated at 100 MHz, proton NMR was used to measure the level of anthraquinone in each of the synthesised polymers. Spectra were recorded in deuterated DMSO and syn tetrachloroethane. TMS was the internal standard. The actual levels of grafted dye were 4.9%, 5.3%, 10.0% and 10.4% respectively for the additives gHPC-5, gHPC-10, gHPC-15 and gHPC-20. These were calculated by measurement of the peak integrals in the aromatic region for the bromo-anthraquinone (chemical shift 8=7–8.5 ppm) and the aliphatic region of the polymer, hydroxypropylcellulose (centred at the chemical shift 8=1.5–3.3 ppm)

GPC Analysis

GPC measurements were performed on all samples of grafted HPC. The column which measured 600 mm×7.5 mm was packed with 5 μm grade MIXGEL and operated at 60° C. DMF with 1% LiBr was the solvent which passed through the column at a flow rate of 0.6 ml/min. Values of molecular weight were calculated with respect to a polystyrene standard.

Dye-binder System

A standard solution of ethylhydroxy ethylcellulose (EHEC) binder and the red anthraquinone dye was prepared which produced glossy, amorphous films upon casting. A K-bar was used to cast the solution onto a 6 μm Melinex support film. Details of the solvent system which was a mixture of methylene chloride, methanol and cyclohexanone are given in table 5. A small amount of cyclohexanone served the purpose of reducing the haze caused by phase separation in the system, which otherwise appeared in films cast when it was not present. This solvent system was selected because it dissolved all the components to be used in casting the films, namely EHEC, dye and the four grafted polymers. Several standard solutions were prepared but the optimum solution, which contained the highest percentage of dye possible in the system, and simultaneously produced good quality, amorphous films was the dye mixture of the following composition:

0.3 g EHEC (Grade—extra high)
0.05 g red dye
10 g solvent

On average, six films were cast from the standard solution.

Modified systems were then developed containing the standard solution and the grafted polymer. g-HPC-15 was used throughout to prepare six solutions. Initially, a solution of the additive and solvent was prepared, filtered and added to the standard dye-binder system. ie 0.05 g dye and 0.2 g EHEC. The compositions of these solutions are shown in Table 6.

Using the same procedure, six films of each solution were cast. The resulting thickness of the binder was approximately 1 μm.

A further series of sheets were cast from a solution of EHEC and the polymer additive only, in the solvent system described in Table 5. The films showed no evidence of phase separation on the scale of one micron.

TABLE 5

COMPOSITION OF SOLVENT MIXTURE USED IN THE DYE-BINDER SYSTEM

| SOLVENT | VOLUME $cm^3$ |
|---|---|
| Methanol | 57.5 |
| Methylene Chloride | 37.5 |
| Cyclohexanone | 5.0 |

TABLE 6

GRAFTED POLYMER AND SOLVENT CONTENT IN MODIFIED SYSTEMS

| SOLUTION NO | MASS gHPC | MASS SOLVENT g |
|---|---|---|
| 1 | 0.005 | 20 |
| 2 | 0.015 | 20 |
| 3 | 0.030 | 20 |

KINETIC MEASUREMENTS

(1) Accelerated Ageing Tests

Amorphous samples selected from the dyesheets of the standard solution and solutions 1 to 3, were "aged" using a Fisons Environment Equipment Weatherometer under conditions of constant temperature (40° C.) and relative humidity (60%). The samples were removed from the weatherometer after a duration of 24 hours.

(2) Hotstage Microscope Experiment

Small sections of unweathered film from the standard solution and solutions 1 to 3 were chosen, which appeared visually to be amorphous. The samples were heated on the hotstage and the rates of crystallisation were monitored by recording the growth of rosettes in the dye-binder film. This procedure was viewed by coupling a panasonic video-recorder to a Zeiss optical microscope. The samples were heated from a temperature of approximately 40° C. to 100° C. at a constant rate of 30° C. per minute.

Full crystallisation was judged to have occurred when no trace of the initial uncrystallised dye remained in the field of view.

Photographs were taken upon full crystallisation from amorphous films of the standard and the 3 modified systems under observation.

TABLE 7

Actual Levels of Grafting Calculated from Proton NMR Analysis

| Example | System | Integrals measured Aliphatic:Aromatic/mm | Ratio of Integrals Aliphatic:Aromatic | % Grafting Theory | % Grafting Observed |
|---|---|---|---|---|---|
| 7 | gHPC-5 | 1376:45 | 1:0.069 | 5 | 4.9 |
| 8 | gHPC-10 | 2368:83 | 1:0.066 | 10 | 5.3 |
| 9 | gHPC-15 | 1008:67 | 1:0.035 | 15 | 9.9 |
| 10 | gHPC-20 | 1504:104 | 1:0.033 | 20 | 10.4 |

TABLE 8

Crystallisation of the Standard and Modified Systems

| Solution Used | Time taken by resulting dyesheet to crystallise fully minutes | Ratio of dye groups attached to polymeric additive to free dye in dye sheet w/w % |
|---|---|---|
| Control-B | 25 | 0 |
| 1 | 61 | 0.5% |
| 2 | 64 | 1.5% |
| 3 | 61 | 3.0% |

Results from the hotstage microscope experiments revealed that initially nucleation was rapid when the dyesheets were heated to 100° C. but when the polymeric crystallisation inhibitor was present the subsequent crystallisation was much slower. The rate of crystallisation was approximately halved in the presence of the additive. From these results we have shown that by using a polymeric additive that contains pendant dye groups along its backbone the crystallisation of the free dye in the dyesheet is inhibited as in the first example but that by using an additive which is able to mix more intimately with the binder polymer the effect can be achieved with much smaller quantities of additive.

EXAMPLES 11-15

In a third set of experiments, the work was repeated except that a different dye was employed to demonstrate the more general applicability of the principle to use specifically designed polymeric additives to inhibit the crystallisation of organic thermal transfer dyes in the dyesheet.

The dyesheet was prepared as before by casting from solution which was prepared from the formulation,

| | | |
|---|---|---|
| Binder | Ethylhydroxyethyl celluose, EHEC | 1.6 g |
| Dye | 1-n-butyl-5-(4-chlorophenylazo)-3-cyano-6-hydroxy-4-methylpyrid-2-one | 0.53 g |
| Solvent | Tetrahydrofuran | 15.6 g |

Synthesis of the Polymeric Additive

The polymeric additive was against based on the cellulose structure which was modified to contain a multiplicity of chemically bound moieties which were identical in structure to that of the low molar mass dye.

Thus typically 10 g of hydroxypropyl cellulose, HPC prepared as before was dissolved in 25 ml of dry pyridine. To this stirring solution at room temperature was added 1 g of the acid derivative of the dye, namely 1-n-butyl-5-(4-carboxyphhenylazo)-3-cyano-6-hydroxy-4-methylpyrid-2-one in the form of the acid chloride.

The mixture was stirred at room temperature for a further 3 hours, and the modified polymer was recovered by precipitation by ethylacetate. The yellow polymer was purified by repeated dissolution in chloroform and precipitation by ethylacetate, and finally dried in vacuo at 40° C.

The grafted HPC in this example was characterised by NMR, FTIR and UV/visible spectrometry. All techniques confirmed the success of the chemical reaction and the degree of grafting to the polymer was calculated from NMR integrals. The degree of grafting which is expressed as a ratio of weight of dye now bound chemically to the polymer, to the weight of the polymer was measured to be 6% (w/w).

Dye Sheet Systems

A number of dyesheets were prepared by spreading a solution of dye, EHEC and polymeric additive in tetrahydrofuran onto a polyester film. The details of the solutions which were used are recorded in the table below

TABLE 9

Composition of Dye, Binder and Additive Solutions used to prepare Dyesheets

| Example | WtEHEC (g) | Wt Dye (g) | Wt polymeric Additive (g) | THF | WtHPC (g) | Nuclei Observed 50 cm$^2$ | Composition Reference |
|---|---|---|---|---|---|---|---|
| 11 | 1.6 g | 0.53 | | 15.6 | | 18,000-20,000 | Control-C |
| 12 | 1.6 | .53 | .059 | 15.6 | | | #1 |
| 13 | 1.6 | .53 | .118 | 15.6 | | | #2 |
| 14 | 1.6 | .53 | .236 | 15.6 | | ~1500 | #3 |
| 15 | 1.6 | .53 | .475 | 15.6 | | 80-100 | #4 |
| 16 | 1.6 | .53 | .955 | 15.6 | | 10-20 | #5 |
| 17 | 1.6 | .53 | | 15.6 | 0.5 | 3,000-4,000 | #6 |

Kinetic Measurement

(1) Accelerated Ageing Tests

A sample of each dyesheet that was prepared was subjected to heating in air at 135° C. for different fixed periods of time. Upon recovery the yellow dye was seen to have nucleated and crystallised within the dyesheets to different extents. The number of nuclei per unit area of dyesheet (50 cm$^2$) was recorded in each case.

(2) Hotstage Microscope

A small section of each dyesheet was subjected to heating from ambient temperature to 140° C. at 20° per minute and the growth of dye crystals within the dyesheet was revealed by a video camera and recorder attached to an optical microscope. The rate of crystallisation of the yellow dye at 140° was then derived.

The results of the crystallisation measurements are summarised in the table below.

| Example | Composition | Induction time before nucleation (minutes) | Rate of Crystallisation (Normalised Units) |
|---|---|---|---|
| 11 | Control-C | 10 | 2.8 |
| 12 | 1 | 10 | 4.0 |
| 13 | 2 | 13 | 7.4 |
| 14 | 3 | 15 | 5.0 |
| 15 | 4 | 6-11 | 3.5 |

The results show that under the conditions chosen the rate of crystallisation of the yellow dye in the dye sheet is only slightly influenced by the presence of the polymeric additive.

However, the nucleation is sensitive to the presence of the additive. This effect is not seen when comparable levels of unmodified HPC are used in place of the grafted HPC additive.

This third example demonstrated further that the principle of designing a polymer crystallisation inhibitor by attaching groups to the polymer backbone which are structurally similar to the crystallising organic dye in a TTP dyesheet, can apply generally to all organic dyes that are contained in polymeric environments before and during use.

We claim:

1. A thermal transfer dye sheet, comprising a supportive based material coated with a composition of a thermally transferable dye dispersed uniformly throughout a polymeric binder matrix, wherein the composition also contains a crystallisation inhibitor having a molecular structure consisting essentially of a polymer backbone to which are chemically bonded a multiplicity of groups which have one of (a) essentially the same chemical structure as the individual thermally transferable dye molecules and (b) a chemical structure which represents a substantial portion of the individual thermally transferable dye molecules, said substantial portion being sufficient to mimic the crystallisation behavior of said thermally transferable dye.

2. A dyesheet as claimed in claim 1 wherein the polymer backbone is compatible with the polymeric binder.

3. A dyesheet as claimed in claim 1 or claim 2 wherein the groups bonded to the polymer backbone have essentially the same chemical structure as the individual dye molecules, being substituted only to form the chemical bond to the backbone.

4. A dyesheet as claimed in claim 1 wherein the groups are bonded to the polymer backbone through a flexible linking group.

5. A dyesheet as claimed in claim 1, wherein crystallisation inhibitor is present as 0.01–10% w/w of the dye.

* * * * *